US007646352B2

(12) United States Patent
Ni

(10) Patent No.: US 7,646,352 B2
(45) Date of Patent: Jan. 12, 2010

(54) ULTRA-WIDEBAND LOG-PERIODIC DIPOLE ARRAY WITH LINEAR PHASE CHARACTERISTICS

(75) Inventor: Nan Ni, Goleta, CA (US)

(73) Assignee: Agile RF, Inc., Goleta, CA (US)

( * ) Notice: Subject to any disclaimer, the term of this patent is extended or adjusted under 35 U.S.C. 154(b) by 20 days.

(21) Appl. No.: 12/174,461

(22) Filed: Jul. 16, 2008

(65) Prior Publication Data

US 2009/0027292 A1 Jan. 29, 2009

Related U.S. Application Data

(60) Provisional application No. 60/951,668, filed on Jul. 24, 2007.

(51) Int. Cl.
*H01Q 11/10* (2006.01)
*H01Q 21/00* (2006.01)

(52) U.S. Cl. ..... 343/792.5; 343/810

(58) Field of Classification Search ..... 343/792.5, 343/810–812, 814, 816, 820, 853
See application file for complete search history.

(56) References Cited

U.S. PATENT DOCUMENTS 5,093,670 A * 3/1992 Braathen ..... 343/792.5
6,734,827 B2 5/2004 Killen et al.
7,292,197 B2 * 11/2007 Goldberg et al. ..... 343/792.5
7,365,699 B2 4/2008 Grebel et al.

FOREIGN PATENT DOCUMENTS

WO WO 02/084790 A1 10/2002

OTHER PUBLICATIONS

PCT International Search Report and Written Opinion, PCT/US08/070337, Oct. 2, 2008.

* cited by examiner

*Primary Examiner*—Michael C Wimer
(74) *Attorney, Agent, or Firm*—Fenwick & West LLP

(57) ABSTRACT

A log-periodic dipole array system employs a structure for the transmitter and the receiver designed in a way such that they compensate for the non-linear characteristics of each other to realize linear phase characteristics as a pair. Radiation elements on the receiver are positioned with respect to its corresponding transmission line in an order opposite to the positioning of the radiation elements on the transmitter. Although neither the transmitter dipole array nor the receiver dipole array itself has linear phase characteristics, the overall dipole array antenna system can realize linear phase characteristic. The log-periodic dipole array system has the advantages that linear phase characteristics can be obtained without sacrificing high radiation efficiency and gain.

8 Claims, 6 Drawing Sheets

ULTRA-WIDEBAND LOG-PERIODIC DIPOLE ARRAY WITH LINEAR PHASE CHARACTERISTICS

CROSS-REFERENCE TO RELATED APPLICATION

This application claims priority under 35 U.S.C. §119(e) from U.S. Provisional Patent Application No. 60/951,668 entitled "Ultra-Wideband Log-Periodic Dipole Array with Linear Phase Characteristics," filed on Jul. 24, 2007, which is incorporated by reference herein in its entirety.

BACKGROUND OF THE INVENTION

1. Field of the Invention

The present invention relates to Broadband/Ultra-wideband (UWB) antenna design.

2. Description of the Related Art

Ultra-Wideband (UWB) communication has been the subject of intense research over the last few years. The essence of UWB systems is the ability to transmit and receive UWB pulses, which occupy a bandwidth over several octaves. A UWB system needs an antenna that maintains good phase and amplitude linearity over a wide bandwidth.

Broadband antennas have been studied in the past for short pulse applications. Basically, there are two ways to achieve broadband functionality in an antenna. One is to broaden the bandwidth of currently available antennas, i.e., using one radiation element to cover the entire UWB bandwidth. The other approach is to use an antenna array for UWB applications. The antenna array is made of several radiation elements, with each of which covering a relatively narrow bandwidth, with their sum of bandwidths complying with the UWB requirements.

FIG. 1 shows a conventional 2-element Log-periodic Dipole Array (LPDA) 100 in schematic form. In general, an LPDA is a broadband, multi-element, unidirectional, narrow-beam antenna with impedance and radiation characteristics that are regularly repetitive as a logarithmic function of the excitation frequencies. The individual radiation elements in LPDA are dipole antennas. In a LPDA, there are several radiation elements or dipoles (for example, radiation element 1 (102) and radiation element 2 (104)), each of which covers a narrow bandwidth, and the LPDA 100 uses a single transmission line 108 to connect all the radiation elements (e.g., the two elements 102, 104) in order to achieve broader bandwidth.

Assume that element 1 (102) has a resonant frequency $f_1$, and that element 2 (104) has a resonant frequency $f_2$. If signals 106 with frequencies $f_1$ and $f_2$ are fed into the LPDA 100 at the same time, signals with frequency $f_1$ will be radiated into free space by element 1 (102) while signals with frequency $f_2$ will move along the transmission line 108 further since frequency $f_2$ is not the resonant frequency of element 1 (102). Signals with frequency $f_2$ will experience some additional delay caused by the transmission line 108 until it is radiated into the free space by element 2 (104). Obviously, such a radiation mechanism would introduce a non-constant group delay, i.e., non-linear phase characteristics.

Such non-linear phase characteristic will be even worse if a pair of LPDAs is used for UWB signal transmission and reception. FIG. 2 shows an example of using the LPDAs 100, 130 as the transmitter and receiver, respectively. Note that the elements 122, 124 in the LPDA 130 on the receiver side are arranged in orientation to the transmission line 128 identically to the way the elements 102, 104 in the LPDA 100 on the transmitter side are arranged in orientation to the transmission line 108. Because of the non-linear phase characteristics, signals with frequency $f_1$ are radiated first and signals with frequency $f_2$ are radiated later with a delay caused by the transmission line 108. As a result, the signal with frequency $f_1$ arrives at the receiver LPDA 130 earlier than the signals with frequency $f_2$. In addition, signals with frequency $f_2$ travel further along the transmission line 128 until it reaches its signal output 120, adding an extra delay between the signals with frequency $f_1$ and the signals with frequency $f_2$. Therefore, the original signals cannot be recovered.

FIGS. 3 and 4 show another conventional antenna array 300, referred to as Independently Center-fed Dipole Array (ICDA), for ultra-wideband applications, in schematic form. The ICDA also uses several narrowband radiation elements (e.g., two radiation elements 302, 304) in order to cover a broad bandwidth. However, the feed network 308 in the ICDA is different from that in LPDAs. Instead of having all the dipole elements serially connected by a transmission line, each element 302, 304 in the ICDA is fed independently through its own transmission line 320, 322, and all the transmission lines 320, 322 are connected at a splitting point 314 to the common transmission line 308 coupled to the input signal source 306. In other words, a broadband signal would travel on transmission line 308, be split up at the splitting point 314, and then fed into all the dipole elements 302, 304 via separate transmission lines 320, 322. By using the same transmission line 308 for both elements 302, 304 and then splitting up to separate transmission lines 320, 322 with equal length at the splitting point 314, all frequency components of the signal will be simultaneously fed into and radiated out by the corresponding active elements 302, 304.

Although the ICDA has linear phase characteristics, it also has low radiation efficiency. FIG. 4 shows an ICDA with N radiation elements. Referring to FIG. 4, the input signal 310 would travel on transmission line 308, and then be split up at junction 314 to N waves on separate transmission lines 320, 322, and propagate to each port corresponding to each radiation element (302, 304 . . . ). Thus, each radiation element would receive only a small portion of the original incident wave 310. For example, the incident wave 312 that is transmitted to element 1 (302) is only a small portion of the original incident wave 310. Thus, radiation efficiency is low in ICDAs.

SUMMARY OF THE INVENTION

Embodiments of the present invention include a dipole array antenna system, comprising (i) a transmitter dipole array including at least a first radiation element and a second radiation element coupled to a first transmission line, the first radiation element positioned on the first transmission line at a first distance from a signal input to transmitter dipole array and the second radiation element positioned on the first transmission line at a second distance from the signal input, the second distance being larger than the first distance, and (ii) a receiver dipole array including at least a third radiation element and a fourth radiation element coupled to a second transmission line, radiation characteristics of the third radiation element and the fourth radiation element being substantially same as radiation characteristics of the first radiation element and the second radiation element, respectively, and the third radiation element positioned on the second transmission line at a third distance from a signal output from the receiver dipole array and the fourth radiation element positioned on the second transmission line at a fourth distance from the signal output, the third distance being larger than the fourth distance. In one embodiment, a difference between the first distance and the second distance is substantially same as a difference between the third distance and the fourth distance.

According to the dipole array antenna system of the present invention, the first radiation element is configured to radiate a first frequency signal, the second radiation element is configured to radiate a second frequency signal, the third radiation element is configured to receive the first frequency signal, and the fourth radiation element is configured to receive the second frequency signal. The first frequency signal is transmitted by the first radiation element at a first timing and the second frequency signal is transmitted by the second radiation element at a second timing delayed by a first time delay with respect to the first timing. The first frequency signal is received by the third radiation element at a third timing and the second frequency signal is received by the fourth radiation element at a fourth timing delayed by a second time delay substantially the same as the first time delay. The first frequency signal is transmitted on the second transmission line during the second time delay and combined together with the second frequency signal at the signal output at substantially the same time, with linear phase. In other words, the first frequency signal and the second frequency signal will experience the same total delay when reaching the signal output. Therefore, although neither the transmitter dipole array nor the receiver dipole array itself has linear phase characteristics, the overall dipole array antenna system can realize linear phase characteristic. The dipole array system of the present invention has the advantages that linear phase characteristics can be obtained without sacrificing high radiation efficiency and gain.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 5:
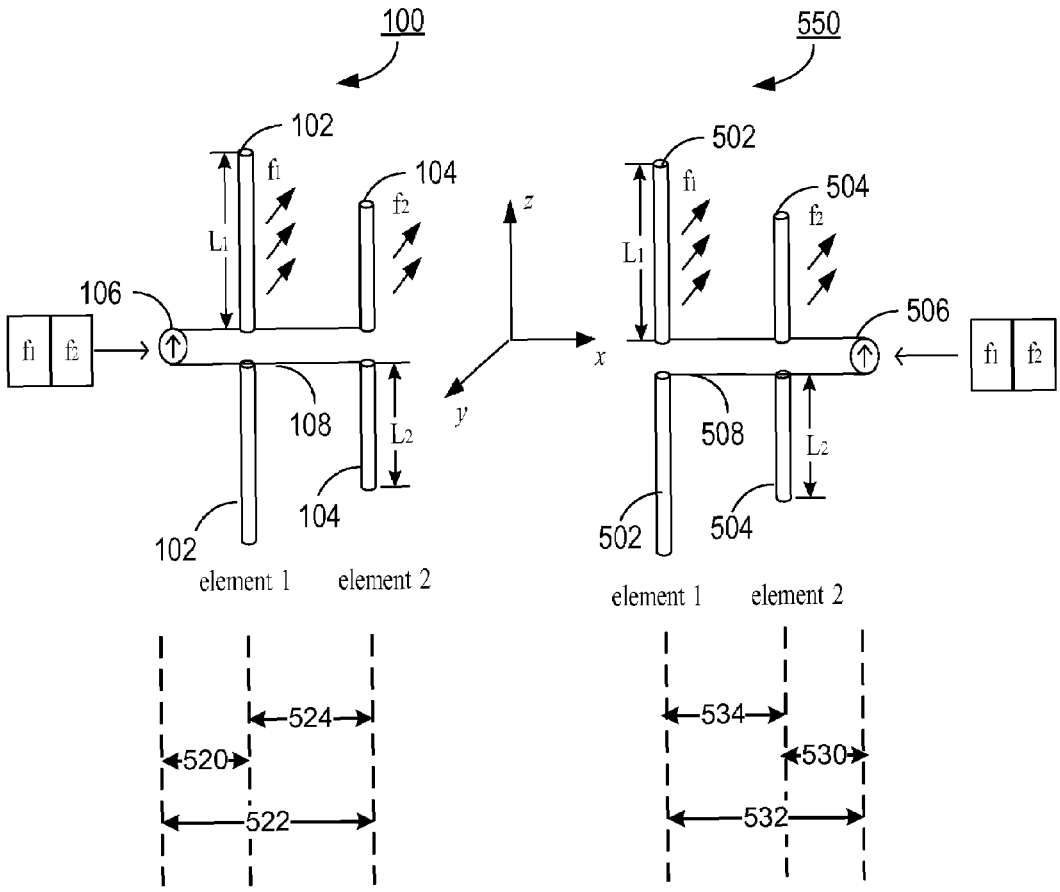
FIG. 5 shows a 2-element ultra-wideband log-periodic dipole array (transmitter and receiver), according to one embodiment of the present invention.

FIG. 5 shows a 2-element ultra-wideband log-periodic dipole array system (transmitter and receiver), according to one embodiment of the present invention. The ultra-wideband LPDA of the present invention can be used for ultra-wideband applications while keeping high radiation efficiency. Unlike conventional LPDAs used as the transmitter and the receiver, the LPDA of the present invention is designed to have different structures for transmitter and receiver.

Figure 6:
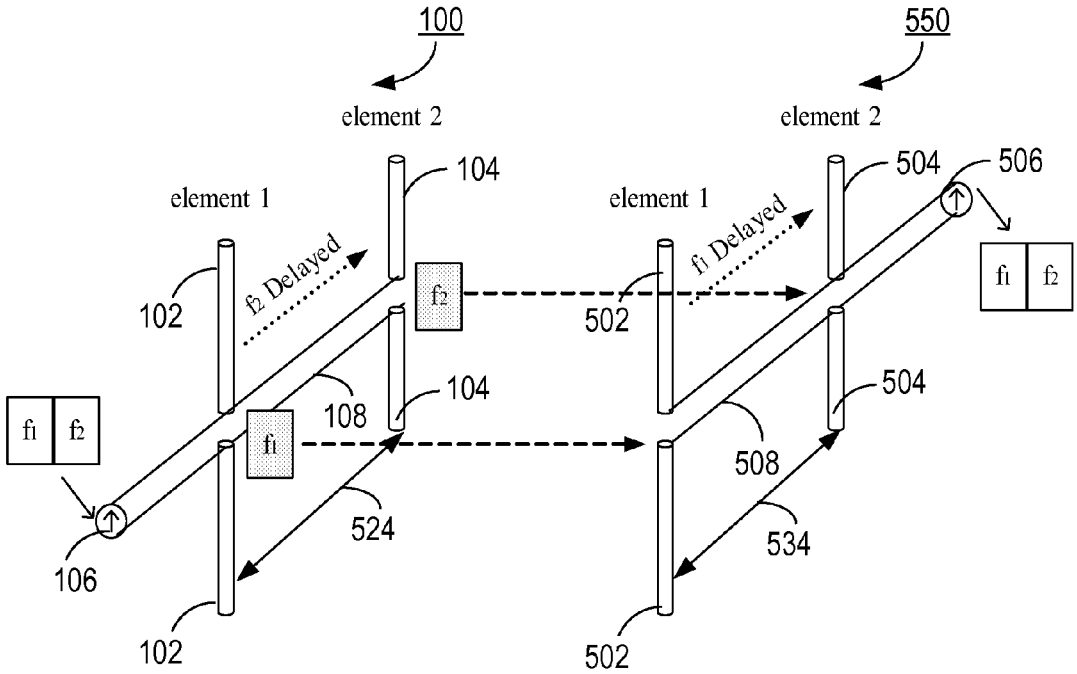
FIG. 6 shows how the signal is transmitted and received in the pair of ultra-wideband log-periodic dipole arrays, according to one embodiment of the present invention.

FIG. 5 shows both structures of the transmitter 100 and the receiver 550). Both the transmitter 100 and the receiver 550 use several narrowband radiation elements or dipoles (e.g., elements 102, 104 and elements 502, 504) to cover a wide bandwidth. Radiation element 102 on the transmitter side 100 and radiation element 502 on the receiver side 550 are identical and have substantially the same length, i.e., substantially the same radiation characteristics. Likewise, radiation element 104 on the transmitter side 100 and radiation element 504 on the receiver side 550 are identical and have substantially the same length, i.e., substantially the same radiation characteristics. In the examples of FIG. 5 and FIG. 6, assume that radiation elements 102, 502 are configured to have resonant frequencies consistent with the excitation frequency $f_1$ of the input signal 106 and that radiation elements 104, 504 are configured to have resonant frequencies consistent with the excitation frequency $f_2$ of the input signal. Since transmitter 100 and receiver 550 are both LPDAs, radiation element 102 and radiation element 104 have different lengths, with impedance and radiation characteristics that are regularly repetitive as a logarithmic function of the excitation frequencies $f_1$ and $f_2$ of the input signal source 106. Likewise, radiation element 502 and radiation element 504 have different lengths, with impedance and radiation characteristics that are regularly repetitive as a logarithmic function of the excitation frequencies $f_1$ and $f_2$ of the input signal source 106. In the example of FIG. 5, radiation element 102 is longer than radiation element 104, and radiation element 502 is longer than radiation element 504. Radiation elements 102, 104 on the transmitter side 100 are connected via transmission line 108, and radiation elements 502, 504 on the receiver side 550 are connected by transmission line 508.

Radiation element 102 on the transmitter 100 is positioned on the transmission line 108 at a distance 520 from the input signal source 106. Radiation element 104 on the transmitter 100 is positioned on the transmission line 108 at a distance 522 from the input signal source 106. Radiation element 502 on the receiver 550 is positioned on the transmission line 508 at a distance 532 from the signal output receiver 506. Radiation element 504 on the receiver 550 is positioned on the transmission line 508 at a distance 530 from the signal output receiver 506. In one embodiment, the length 524 of the part of the transmission line 108 between radiation elements 102, 104 on the transmitter side 100 (i.e., the difference between distances 520 and 522) is designed to be substantially the same as the length 534 of the part of the transmission line 508 between radiation elements 502, 504 on the receiver side 550 (i.e., the difference between distances 530 and 532). In one embodiment, distances 520 and 522 are substantially same as distances 530 and 532, respectively.

Figure 1:
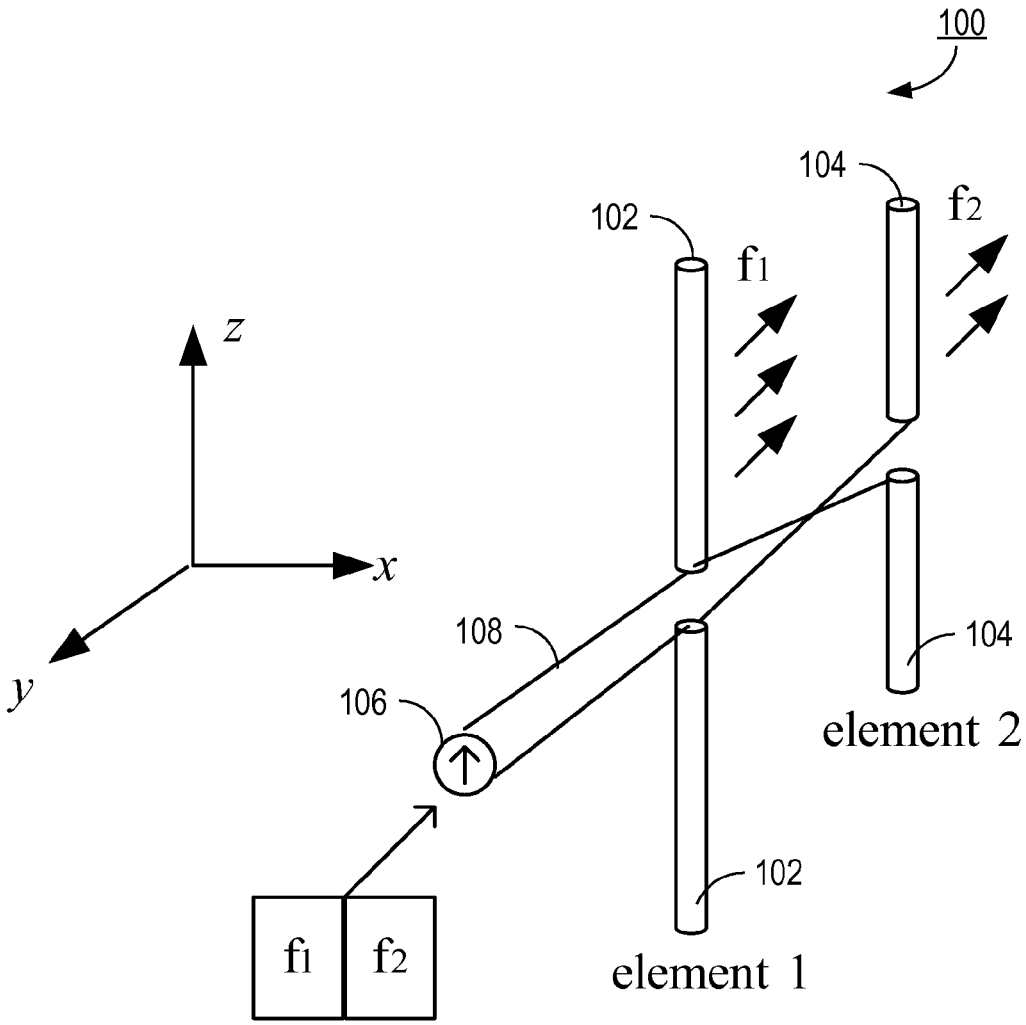
FIG. 1 (PRIOR ART)
FIG. 1 shows a conventional 2-element Log-periodic Dipole Array (LPDA) in schematic form.
Figure 2:
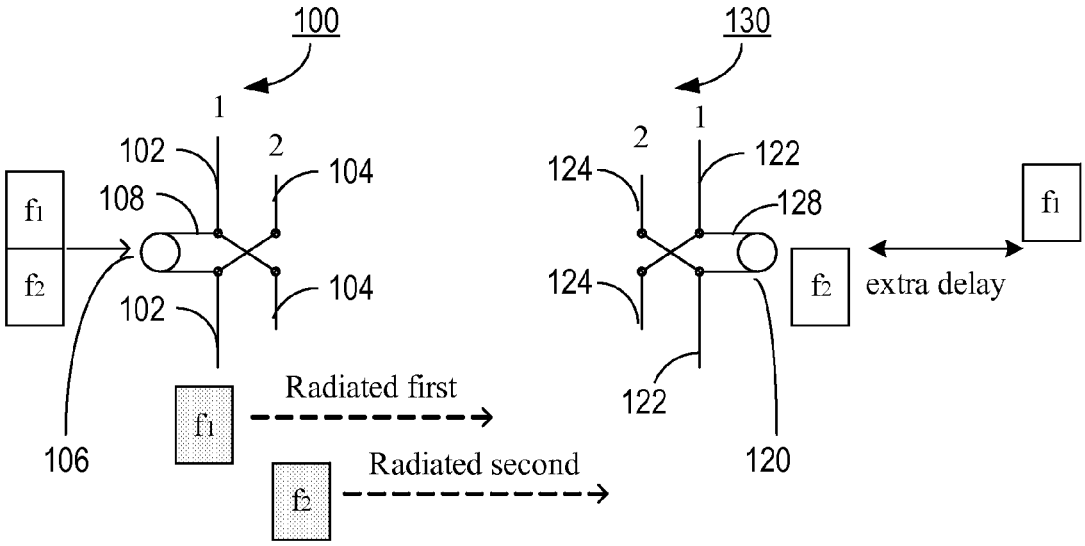
FIG. 2 (PRIOR ART)
FIG. 2 shows an example of using the conventional LPDAs as the transmitter and receiver.
Figure 3:
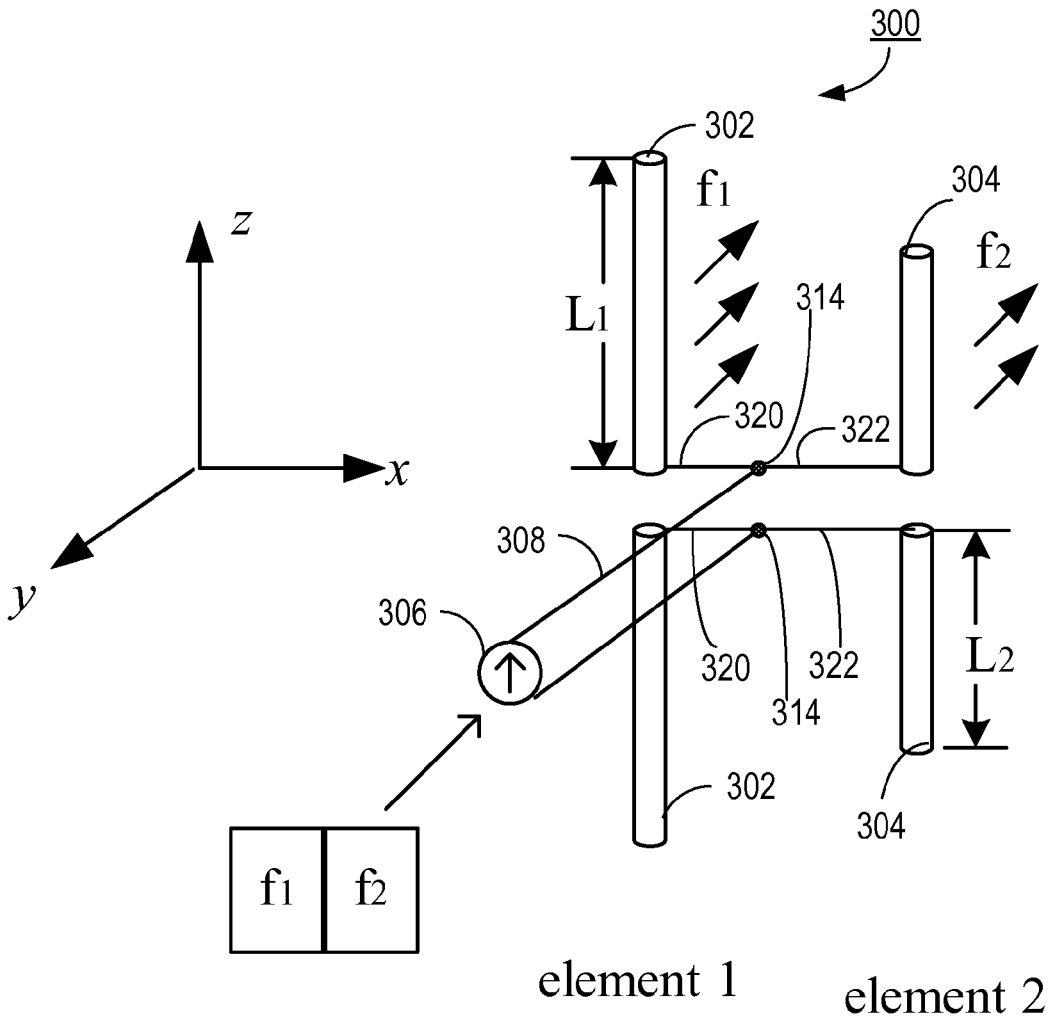
FIG. 3 (PRIOR ART)
FIG. 3 and FIG. 4 show a conventional Independently Center-fed Dipole Array (ICDA).
Figure 4:
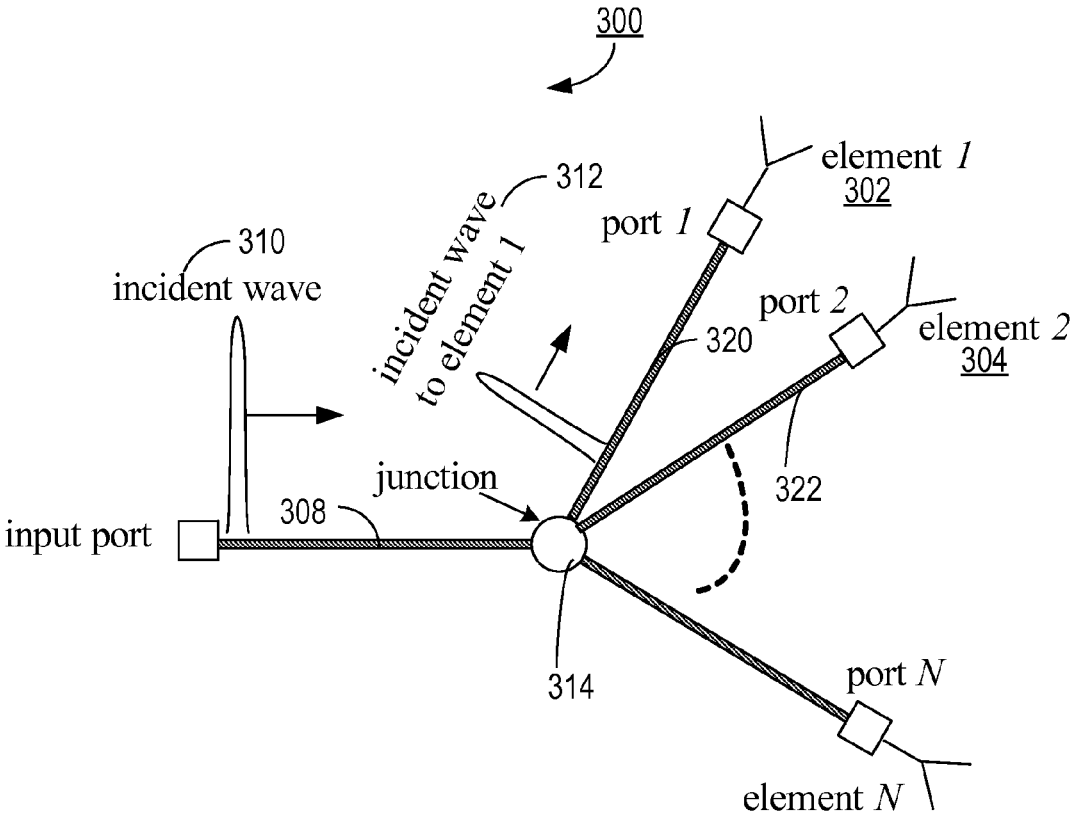
FIG. 4 (PRIOR ART)

According to embodiments of the present invention, the signal input on the transmitter side 100 of the LPDA system is at an end different from the signal output on the receiver side 550 of the LPDA system. More specifically, referring to FIG. 5, the signal input source 106 is connected to the end of transmission line 108 closer to element 102 to feed the radiation elements 102, 104 of the transmitter side with the input radio frequency signal to be radiated. On the other hand, the signal output receiver 506 is connected to the end of the transmission line 508 closer to element 504 rather than element 502. Thus, if a signal including frequency components $f_1$ and $f_2$ is fed into the transmitter 100 from input signal source 106, it will reach element 1 (102) first and element (104) later on the transmitter side 100. On the other hand, on the receiver side 550 the received signal will reach element 1 (502) first and element 2 (504) later. Note that this is opposite from the conventional LPDA shown in FIG. 2, where both the signal input source 106 and the signal output receiver 110 are connected to the end closer to elements 102, 122.

FIG. 6 shows how the signal is transmitted and received in the pair of ultra-wideband log-periodic dipole arrays, according to one embodiment of the present invention. On the transmitter side 100, an input signal including frequency components $f_1$ and $f_2$ is fed from input signal source 106 into the transmitter 100. The frequency component $f_1$ is transmitted on the transmission line 108 and reaches its corresponding radiation element 102 (with resonant frequency $f_1$) first, while the frequency component $f_2$ is transmitted on the transmission line longer and reaches its corresponding radiation element 104 (with resonant frequency $f_2$) later with a delay. Thus, frequency component $f_1$ will be radiated from the transmitter 100 into the free space first, and the frequency component $f_2$ will be radiated from the transmitter 100 into free space next, after a delay caused by the part 524 of transmission line 108 between radiation elements 102, 104.

On the receiver side 550, the frequency component $f_1$ is picked up by radiation element 1 (102) first. However, because the length 524 of the inter-element transmission line 108 between the radiation elements 102, 104 on the transmitter side 100 is substantially the same as the length 534 of the inter-element transmission line 508 between the radiation elements 502, 504 in the receiver 550, the frequency component $f_1$ will experience the same delay that the frequency component $f_2$ experienced on the transmitter side 100. By the time the received frequency component $f_1$ reaches radiation element 2 (504) on the receiver side 550, the frequency component $f_2$ will also be picked up by radiation element 2 (504) on the receiver side 550 at substantially the same moment. Therefore, at the output receiver 506 of the receiver 550, both frequency components $f_1$ and $f_2$ are collected by the signal output receiver 506 at substantially the same time, and the received signal can be recovered with linear phase (same group delay).

As can be seen from above, neither the transmitter 100 nor the receiver 150 has linear phase, since one frequency will be radiated (or received) earlier than the other frequency. However, the non-linear phase characteristics of the transmitter 100 is corrected and compensated for by the receiver 150 through opposite arrangements of the radiation elements with respect to the inter-element transmission lines and signal inputs/outputs. In other words, the frequency which is radiated into free space first (or last) will be picked up by the receiver first (or last), respectively. Both frequencies would experience the same delay in the inter-element transmission lines 108, 508, since the lengths 524, 534 of inter-element transmission lines 108, 508 in the transmitter 100 and the receiver 550, respectively, are substantially the same. Therefore, at the output 506 of the receiver 150, the signal can be recovered with linear phase (same group delay).

Upon reading this disclosure, those of skill in the art will appreciate still additional alternative designs for LPDA system with linear phase characteristics. For example, while the present invention is illustrated with two radiation elements on each of the transmitter and the receiver, a different number (two or more) of radiation elements may be present on each of the transmitter and the receiver, positioned with respect to their corresponding transmission lines according to the present invention. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A dipole array antenna system, comprising:

a transmitter dipole array including at least a first radiation element and a second radiation element coupled to a first transmission line, the first radiation element positioned on the first transmission line at a first distance from a signal input to the transmitter dipole array and the second radiation element positioned on the first transmission line at a second distance from the signal input, the second distance being larger than the first distance; and a receiver dipole array including at least a third radiation element and a fourth radiation element coupled to a second transmission line, radiation characteristics of the third radiation element and the fourth radiation element being substantially same as radiation characteristics of the first radiation element and the second radiation element, respectively, and the third radiation element positioned on the second transmission line at a third distance from a signal output from the receiver dipole array and the fourth radiation element positioned on the second transmission line at a fourth distance from the signal output, the third distance being larger than the fourth distance.

2. The dipole array antenna system of claim 1, wherein a difference between the first distance and the second distance is substantially same as a difference between the third distance and the fourth distance.

3. The dipole array antenna system of claim 1, wherein the first radiation element and the third radiation element are of substantially same length.

4. The dipole array antenna system of claim 1, wherein the second radiation element and the fourth radiation element are of substantially same length.

5. The dipole array antenna system of claim 1, wherein the first radiation element is configured to radiate a first frequency signal, the second radiation element is configured to radiate a second frequency signal, the third radiation element is configured to receive the first frequency signal, and the fourth radiation element is configured to receive the second frequency signal.

6. The dipole array antenna system of claim 5, wherein:

the first frequency signal is transmitted by the first radiation element at a first timing and the second frequency signal is transmitted by the second radiation element at a second timing delayed by a first time delay with respect to the first timing;

the first frequency signal is received by the third radiation element at a third timing and the second frequency signal is received by the fourth radiation element at a fourth timing delayed by a second time delay substantially same as the first time delay; and the first frequency signal is transmitted on the second transmission line during said second time delay and combined together with the second frequency signal at the signal output at substantially the same time.

7. The dipole array antenna system of claim 5, wherein the first frequency signal and the second frequency signal are combined together with linear phase at the receiver dipole array.

8. The dipole array antenna system of claim 1, wherein the transmitter dipole array and the receiver dipole array are log-periodic dipole arrays.

* * * * *